US005175524A

United States Patent [19]

Gotoh

[11] Patent Number: 5,175,524

[45] Date of Patent: Dec. 29, 1992

[54] ELECTROMAGNETIC SWITCHGEAR

[75] Inventor: Takeo Gotoh, Hyogo, Japan

[73] Assignee: Mitsubishi Denki K.K., Tokyo, Japan

[21] Appl. No.: 735,219

[22] Filed: Jul. 24, 1991

[30] Foreign Application Priority Data

Jul. 25, 1990 [JP] Japan ..... 2-198560

[51] Int. Cl.[5] ..... H01H 67/02

[52] U.S. Cl. ..... 335/126; 335/131

[58] Field of Search ..... 335/126, 131

[56] References Cited

FOREIGN PATENT DOCUMENTS 56-30124 7/1981 Japan .

57-14347 3/1982 Japan .

*Primary Examiner*—Lincoln Donovan

*Attorney, Agent, or Firm*—Sughrue, Mion, Zinn, Macpeak & Seas

[57] ABSTRACT

An electromagnetic switchgear is characterized in that either a fixed or a moving member is furnished with a contact member having a contact area smaller than an area resulting from the meeting between the fixed and the moving contact, the contact member being made of wear resistant material.

6 Claims, 4 Drawing Sheets

ELECTROMAGNETIC SWITCHGEAR

BACKGROUND OF THE INVENTION

1. Field of the Invention

The present invention relates to a contact mechanism in an electromagnetic switchgear having fixed contacts and a moving contact.

FIG. 1*a* is an overall sectional view of a conventional electromagnetic switchgear.

An electromagnetic switchgear 1 of the sort shown in FIG. 1*a* has a magnetic path casing 2, and an exciting coil 3 which is wound on a plastic bobbin 4. The exciting coil 3 consists of an absorbing coil 3*a* of thick conductor material and a holding coil 3*b* of thin conductor material. A spool 31 for winding the coils is provided at the rear end of the bobbin 4; the lead conductor 30*a* of the absorbing coil 3*a* and the lead conductor 30*b* of the holding coil 3*b* are led out therefrom, respectively.

Further, the electromagnetic switchgear 1 further has a fixed iron core 5, a guide bushing 6 made of non-magnetic material, the guide bushing 6 being fitted to the inner periphery of the bobbin 4 and secured to the fixed iron core 5, a moving iron core 7 opposite to the fixed iron core 5, the moving iron core 7 being supported in such a way that it is slidable on the inner periphery of the guide bushing 6 in the axial direction, a hook 8 with its rear end portion inserted into a hole 7*a* bored in the moving iron core 7, and a shift lever 9 for moving a start overrunning clutch (not shown), the shift lever 9 being coupled to the hook 8. Further, the electromagnetic switchgear 1 has a spring receptacle 10 secured to the end of the hole 7*a*, a buffer spring 11 for pressing the hook 8 in the backward direction, a reset spring 12 for advancing and resetting the moving iron core 7, and a resin-molded cap 13 coupled via a rubber packing 14 to the end of the fixed iron core 5 and caulked at the end of the magnetic path casing 2.

Moreover, the electromagnetic switchgear 1 has a pair of fixed contacts 15*a* and 15*b* (only one of which is shown), their terminal bolts 16*a* and 16*b* being passed through the cap 13 outwardly and fixed. The terminal of a lead wire from a power supply (storage battery) is connected to one terminal bolt 16, whereas the terminal of a lead wire for the brush of an electric motor is connected to the other terminal bolt 16*b*. In addition, the electromagnetic switchgear 1 has a moving contact 20 opposite to the pair of fixed contacts 15*a* and 15*b* and supported with a moving rod 21 via an insulating member 22, a retaining ring 23, a compression spring 24 for giving the moving contact 20 a contact pressure, a compression spring 15 for advancing and resetting the moving rod 21, and an external terminal 32 connected to the lead conductors 30*a* and 30*b* of the coils with solder 33, the external terminal 32 also being connected to a lead wire from a start switch of an internal combustion engine.

The operation of the electromagnetic switchgear will subsequently be described. When the start switch (not shown) is actuated, the absorbing coil 3*a* and the holding coil 3*b* are caused to conduct and the moving iron core 7 is attracted to the fixed iron core 5 and thereby moves back. The hook 8 also moves back to rotate the shift lever 9, thus advancing the overrunning clutch (not shown). On the other hand, the moving contact 20 that is geared to the backward movement of the moving iron core 7 is moved back to close the fixed contacts 15*a*, 15*b*. Power is thus supplied to the circuit of the electric motor so as to rotate its armature.

A description will then be given of the prior art mechanism of the contact between the fixed contacts and the moving contact.

FIG. 1*b* is an elevational view of the state in which the fixed contacts are kept in contact with the moving contact in the electromagnetic switchgear of FIG. 1*a*. In this example, the fixed contacts 15*a*, 15*b* and the moving contact 20 are generally made of copper or the like.

In the prior art example shown in FIGS. 2*a* and 2*b*, moreover, a contact member 50 of Ag, which is substantially circular, wear resistant and excellent in electric characteristics has been fitted to the whole head area of the fixed contact 15*a* in order to increase its wear resistance.

The contact mechanism of the conventional electromagnetic switchgear having the fixed contacts and the moving contact has the following problems.

In the case of the electromagnetic switchgear shown: in FIGS. 1*a* and 1*b*, the portions in which the moving contact abuts against the fixed contacts are liable to wear and this makes these contact unfit for long-term use.

In the case of what is shown in FIGS. 2*a* and 2*b*, on the other hand, as the contact member 50 of Ag having excellent electric characteristics has been fitted to the substantially whole area of each fixed contact 15*a*, the switchgear of this sort tends to become costly and therefore can hardly be mass-produced.

The wear of the fixed and moving contacts, if analyzed, is caused in such a state that, as shown in FIGS. 3*a* and 3*b*, the metal at the contact into which electrons flow (against which electrons hit) melts and becomes stuck on the opposite contact. Incidentally, a circuit arrangement of the electromagnetic switchgear is shown in FIG. 4.

In the meantime, the contact between the fixed contacts and the moving contact is not determined by a mutual projected area and the contact therebetween remains partial, depending on the surface tolerance and inclination of the contact surface. The partial abutment expedites the fusion of the metal, thus causing the wear of the contact.

SUMMARY OF THE INVENTION

An object of the present invention is to solve the foregoing problems by providing a wear resistant contact mechanism for an electromagnetic switchgear at less cost.

The electromagnetic switchgear according to the present invention is arranged so that each fixed contact and a moving contact are caused to partially abut against each other by providing either fixed or moving contact with a contact member having a contact surface whose area is smaller than the mutually opposed areas of the contacts, so that these contacts become fit for long-term use and less costly.

DETAILED DESCRIPTION OF THE PREFERRED EMBODIMENTS

A description will subsequently be given of embodiments of the present invention.

Figure 1A:
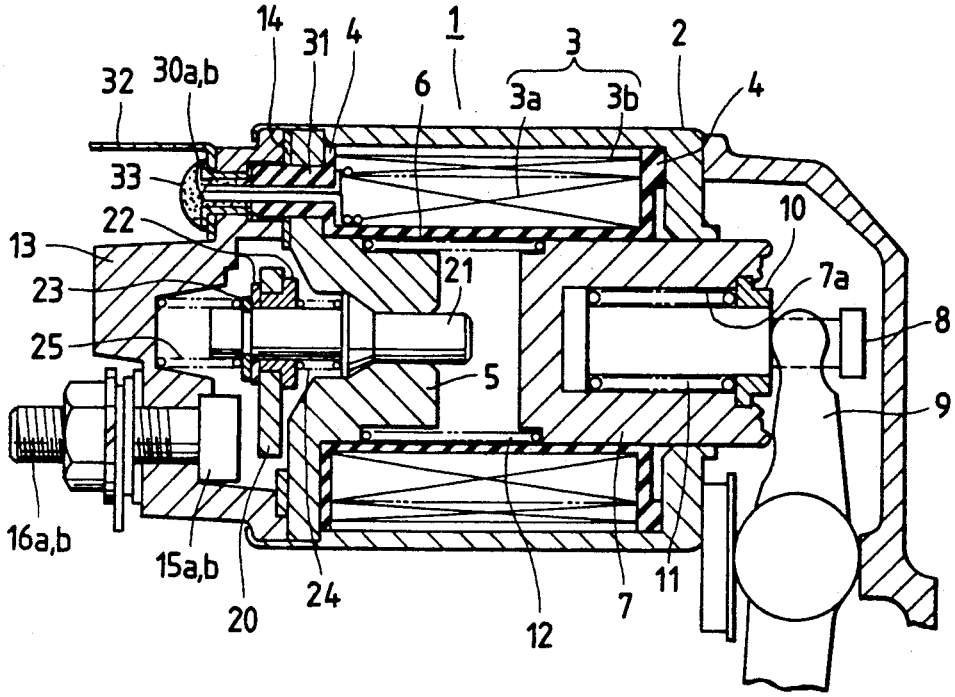
FIG. 1a PRIOR ART
FIG. 1*a* is a sectional view of a conventional electromagnetic switchgear.
Figure 1B:
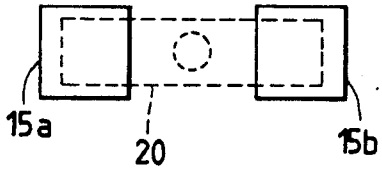
FIG. 1*b* is an elevational view of a combination of fixed contacts and a moving contact that have been brought into contact with each other.
Figure 2A:
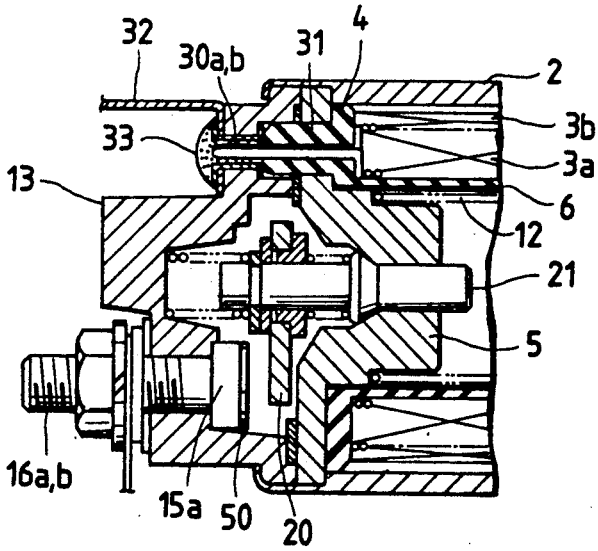
FIG. 2a PRIOR ART
FIG. 2*a* is an overall sectional view of another conventional electromagnetic switchgear.
Figure 2B:
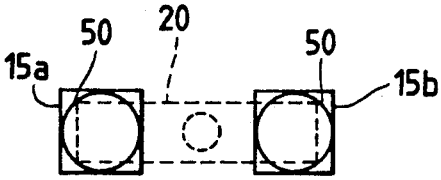
FIG. 2*b* is an elevational view of a combination of fixed contacts and a moving contact that have been brought into contact with each other.
Figure 3A:
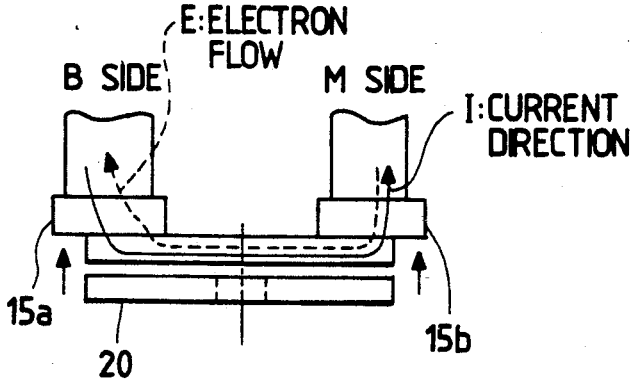
FIGS. 3*a* and 3*b* are constructional diagrams illustrating the situation in which contacts wear.
Figure 3B:
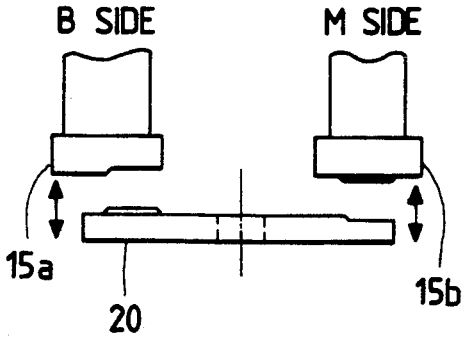
Figure 4:
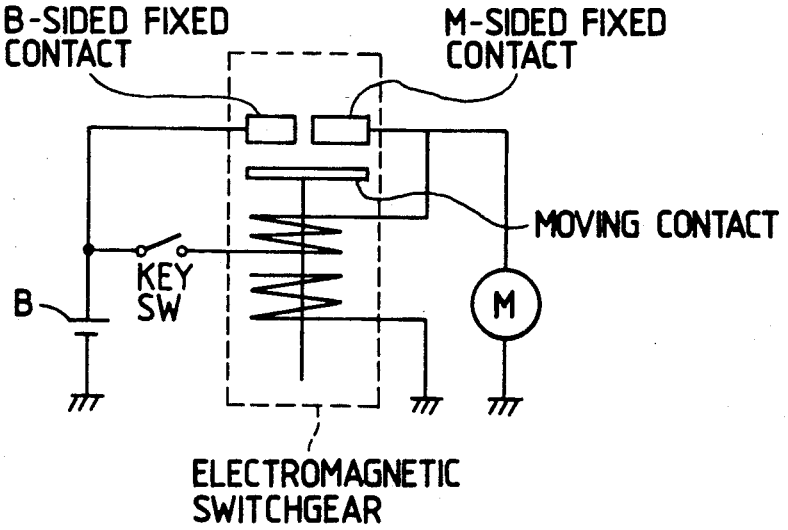
FIG. 4 is a circuit diagram of an electromagnetic switchgear.
Figure 5A:
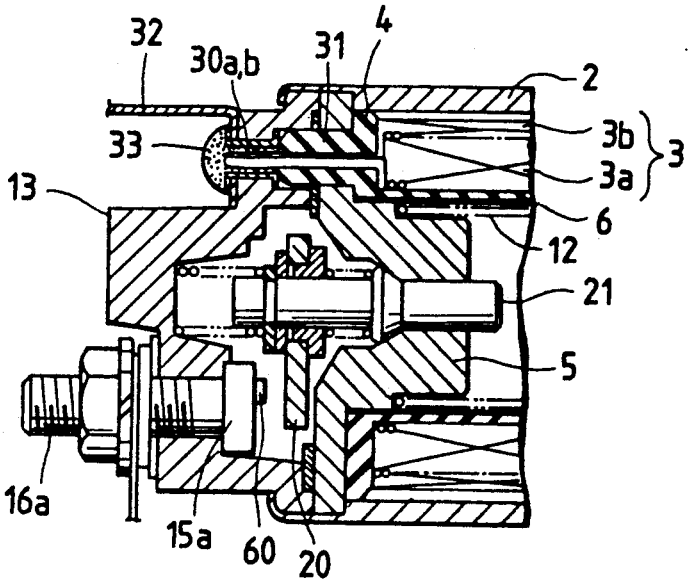
FIG. 5*a* is a sectional view of the principal part of an electromagnetic switchgear according to an embodiment of the present invention.
Figure 5B:
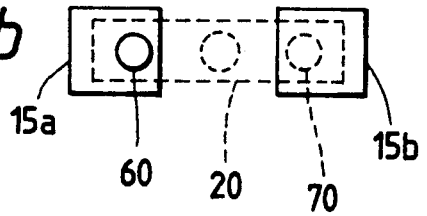
FIG. 5*b* is an elevational view of a combination of fixed contacts and a moving contact that have been brought into contact with each other.
Figure 5C:
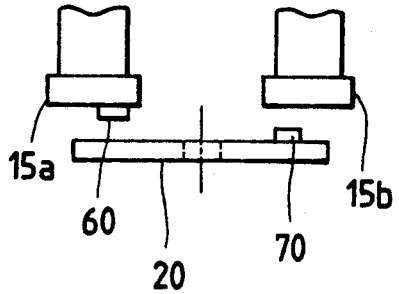
FIG. 5*c* is a side view of the contact state shown in FIG. 5*b*.

FIG. 5*a* is a sectional view of the principal part of an electromagnetic switchgear embodying the present invention. FIG. 5*b* is an elevational view of a combination of fixed contacts and a moving contact that have been brought into contact with each other. FIG. 5*c* is a side view of the contact state shown in FIG. 5*b*.

As shown in these figures, there are furnished a contact member 60 made of wear resistant material of, e.g., Ag to a fixed contact 15*a* on a battery side and a contact member 70 made of wear resistant material of Ag to a moving contact on a motor side. Moreover, these contact members 60, 70 are arranged in such a way that each has an area smaller than a projected area resulting from the meeting between the fixed contacts 15*a*, 15*b* and the moving contact 20. In this embodiment, the provision of the contact members 60 and 70 made of wear resistant material of e.g., Ag for the fixed contact into which electrons flow (against which electrons hit) or the moving contact (the fixed contact 15*a* on the battery side and the moving contact on the motor side) makes the abutment metal into which electrons flow hardly melt, thus rendering it fit for long-term use.

In addition, as the contact members 60 and 70 thus provided have an area smaller than the projected area resulting from the meeting between the fixed and the moving contact, this construction is extremely effective in reducing cost, for instance.

Figure 6A:
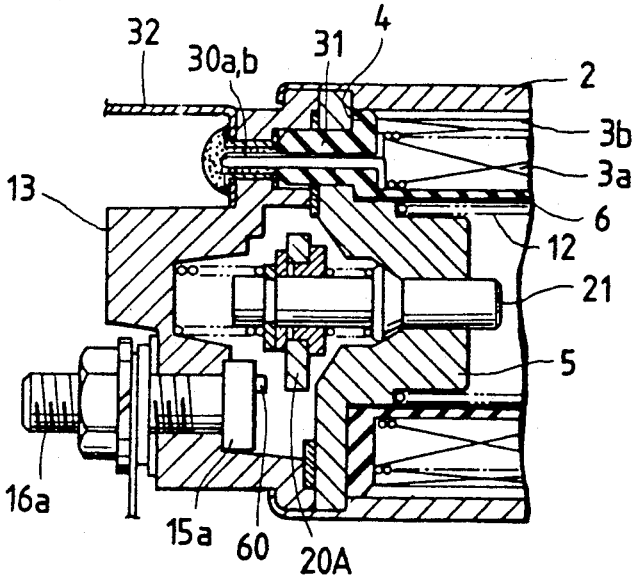
FIG. 6*a* is a sectional view of the principal part of another electromagnetic switchgear embodying the present invention.
Figure 6B:
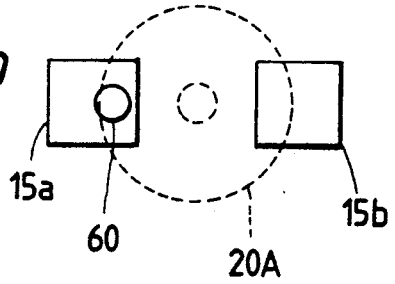
FIG. 6*b* is an elevational view of a combination of fixed contacts and a moving contact that have been brought into contact with each other.
Figure 6C:
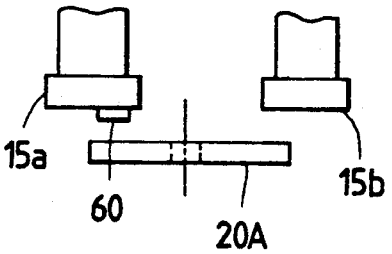
FIG. 6*c* is a side view of the contact state shown in FIG. 6*b*.

FIG. 6*a* is a sectional view of the principal part of another electromagnetic switchgear embodying the present invention. FIG. 6*b* is an elevational view of a combination of fixed contacts and a moving contact that have been brought into contact with each other. FIG. 6*c* is a side view of the contact state shown in FIG. 6*b*.

As shown in these figures, the contact member 60 made of wear resistant material of, e.g., Ag is furnished to the fixed contact 15*a* on a battery side and the contact member 60 has an area smaller than the projected area resulting from the meeting between the fixed and the moving contact. There is also provided a disc-like moving contact 20A which is rotatable on a moving contact shaft.

In this embodiment, the provision of the contact member 60 made of wear resistant material of, e.g., Ag for the fixed contact 15*a* into which electrons flow (against which electrons hit) on the battery side makes the fixed and the moving contact positively abut against each other in that portion of the contact member without letting the metal in the other portion melt, thus rendering it fit for long-term use.

On the other hand, as the moving contact 20A is arranged so that it is rotatable on the moving contact shaft, it uniformly wears and dispenses with the provision of another wear resistant contact member.

As set forth above, as the wear resistant contact member having a contact surface whose area is smaller than the area resulting from the meeting between the fixed and the moving contact is furnished to either the fixed or the moving contact, the electromagnetic switchgear provided according to the present invention is fit for long-term use and advantageous in view of cost reduction.

What is claimed is:

1. An electromagnetic switchgear including a contact structure, said contact structure comprising:

a pair of fixed contacts each having a surface; and a movable contact having a surface which is opposite to the surfaces of said pair of fixed contacts, said movable contact being contactable with said pair of fixed contacts;

wherein one of said pair of fixed contacts and said movable contact is provided with a contact member having a contact area smaller than the surface area of said fixed contacts and said movable contact, the contact member comprising wear-resistant material.

2. A switchgear as claimed in claim 1, wherein said switchgear makes or breaks contact between a power supply and a motor, and wherein one of said pair of fixed contacts is provided on a power supply side and the other is provided on a motor side, the fixed contact at the power supply side being provided with said contact member.

3. A switchgear as claimed in claim 2, wherein said movable contact is provided with said contact member which contacts the other fixed contact at the motor side.

4. A switchgear as claimed in claim 1, wherein said contact member comprises Ag.

5. An electromagnetic switchgear including a contact structure and adapted to make or break contact between a power supply and a motor, said contact structure comprising:

a movable contact which is rotatable and which has a disc-like shape; and a pair of fixed contacts adapted to make contact with said movable contact when said movable contact is energized, one of said pair of fixed contacts being arranged on a power supply side and provided with a wear-resistant material having a contact area smaller than an area at which said fixed and movable contacts make contact.

6. An electromagnetic switchgear as claimed in claim 5, wherein said contact member comprises Ag.

* * * * *